United States Patent [19]

Jourdan

[11] Patent Number: 4,767,455

[45] Date of Patent: Aug. 30, 1988

[54] PROCESS FOR THE PREPARATION OF PURE ALLOYS BASED ON RARE EARTHS AND TRANSITION METALS BY METALLOTHERMY

[75] Inventor: Alex Jourdan, Narbonne, France

[73] Assignee: Comurhex Societe Pour la Conversion de l'Uranium en Metal et Hexafluorure, Courbevoie, France

[21] Appl. No.: 124,574

[22] Filed: Nov. 24, 1987

[30] Foreign Application Priority Data

Nov. 27, 1986 [FR] France ..... 86 16948

[51] Int. Cl.[4] ..... C22C 1/00; C22C 1/02

[52] U.S. Cl. ..... 75/84.4; 75/84.5; 75/84; 420/416

[58] Field of Search ..... 75/84, 84.4, 84.5; 420/416

[56] References Cited

U.S. PATENT DOCUMENTS

| | | | |
|---|---|---|---|
| 3,883,346 | 5/1975 | Martin | 420/455 |
| 3,928,089 | 12/1975 | Cech | 75/84 |
| 4,032,328 | 6/1977 | Hurd | 75/62 |
| 4,135,921 | 1/1979 | Morrice et al. | 420/416 |
| 4,578,242 | 3/1986 | Sharma | 75/84 |
| 4,612,047 | 9/1986 | Schmidt et al. | 75/27 |
| 4,636,353 | 1/1987 | Seon et al. | 420/416 |
| 4,680,055 | 7/1987 | Sharma | 75/84.5 |
| 4,681,623 | 7/1987 | Okajima et al. | 75/5 BB |

FOREIGN PATENT DOCUMENTS

| | | | |
|---|---|---|---|
| 0134162 | 3/1985 | European Pat. Off. | 420/416 |
| 2548687 | 1/1985 | France | 75/84.4 |
| 0073734 | 5/1983 | Japan . | |
| 0082628 | 5/1985 | Japan | 75/84.4 |
| 0084340 | 4/1986 | Japan . | |
| 0157646 | 7/1986 | Japan | 420/416 |

*Primary Examiner*—L. Dewayne Rutledge
*Assistant Examiner*—David Schumoker
*Attorney, Agent, or Firm*—Dennison, Meserole, Pollack & Scheiner

[57] ABSTRACT

An industrial process for the obtaining, preferably without casting, of ingots of high-purity master alloy based on at least one rare earth and at least one transition metal by metallothermic reduction of a compound of said rare earth by means of a reducing agent such as alkali or alkaline earth metals, characterized in that the transition metal is introduced into the starting reaction mixture, at least in part in the form of a compound which can be reduced by the reducing agent used.

22 Claims, No Drawings

PROCESS FOR THE PREPARATION OF PURE ALLOYS BASED ON RARE EARTHS AND TRANSITION METALS BY METALLOTHERMY

TECHNICAL FIELD

The invention relates to an industrial process for the preparation of pure alloys of rare earths and transition metals and possibly other additives in small quantities, by metallurgical thermal reduction of the compounds thereof (halides, oxides . . . ).

This process is applied mainly to the preparation of the master alloy for the manufacture of permanent magnets based on rare earths, in particular neodymium-iron-boron magnets.

STATE OF THE ART

The reaction involving the metallothermic reduction of the compounds of rare earths, including yttrium, which have a positive degree of oxidation, in particular oxides and/or halides, by an alkali or alkaline earth metal is well known.

The use of this reaction for obtaining master alloys of rare earths, iron (or other transition metals such as cobalt, nickel . . . ), boron, which can also contain other elements, from a compound of the rare earths with which Fe and/or boron have been mixed, in which mixture the boron can also be introduced in the form of ferro-boron or a compound thereof is also known (JP No. 60-77943/85 or JP No. 60-27105/85).

The Patent JP No. 59-219404 describes the reduction of rare earth oxides by Ca or $CaH_2$ at 1120° C. The Patent JP No. 60-77943 describes the reduction of oxides or halides of rare earths using Ca in the presence of Fe and B. The boron may be added in the form of halides, oxide or ferro-boron. The Fe may be added in the form of powder or may originate in part from the crucible in which reduction is carried out. The quantity of Ca is from 2 to 4 times the stoichiometric quantity, and the reaction medium is heated under inert gas, with stirring, in the presence of $CaCl_2$ (flux) to a temperature of between 900° and 1200° C. The product is then cast.

Other elements may be added during the reaction to improve the quality of the permanent magnets produced from the alloy obtained.

The Patent Application EP No. 170372 describes the reduction of rare earth oxides by Ca. The oxides are dissolved in a mixture of chloride ($CaCl_2$+NaCl), into which the calcium powder as well as elements such Fe, Zn are introduced to reduce the melting point of the alloy obtained. The reactor is heated to about 650° C.–700° C., the mixture is stirred and $CaCl_2$ is added regularly to keep its concentration at 70%.

As above, Patent Application EP No. 170373 describes a process for reducing the rare earth oxide using Ca, but said calcium is generated in the reaction medium by addition of sodium which reacts with the calcium chloride. The heating temperature is between 650° and 800° C. and the reaction medium is stirred.

The Patent Application FR No. 2 548 687, with its certificate of addition FR No. 2 551 769 describes the reduction of the rare earth halides, to which the elements used in the manufacture of the magnet can be added, by an alkali metal (Na, K, Li) or alkaline earth metal (Ca, Mg) in excess quantities in the presence of a flux ($CaCl_2$ and/or $CaF_2$) of the slag obtained. The heating temperature is between 800° C. and 1100° C. and the reaction takes place under an inert atmosphere.

These processes for the preparation of alloys of rare earths in which the metallic alloying agents are introduced in their elementary form into more or less viscous liquid baths lead to undesirable inclusions of slag in the metal phase obtained and to questionable purity of the alloy: in particular, presence of oxygen, reducing metal, halides . . . . This is despite the search for good conditions for separation of the slag and metal phases, obtained, on the one hand, by lowering, as far as possible, the melting points of said phases by the preferred use of eutectic compositions of which the melting points may range from 650° C. to 800° C., on the other hand by employing heating temperatures of up to 1100° C.

Furthermore, as the rare earths are very aggressive and have a high reducing power, the choice of a reactor which is refractory and inert is difficult. The metals are generally attached by the rare earths and can thus pollute the alloy. Only tantalum and boron nitride resist well, but these are expensive materials which are difficult to use, thus making industrial utlization problematic and impractical. However, the use of crucibles made of varying grades of iron or steel has been proposed. In fact, the iron is dissolved by the rare earths, but it does not contribute any polluting elements because it is itself a constituent of the alloy. This solution can be considered at the expense of operating precautions: limitation of duration and temperature. Ill-defined separation between the molten alloy and the crucible is thus obtained, making it necessary to recover the alloy by casting which is a source of pollution and inclusions, or leading to very heterogeneous Fe contents in the alloy after cooling in a lost crucible.

The usual ceramic materials such as those based on alumina, magnesium, silica, have the tendency, on the one hand, to be reduced by the reducing metal used or by the rare earths produced, in particular by neodymium and thus to be a source of pollution for the alloy and, on the other hand, to be attacked by the slag produced, making care of the reactor difficult in the course of time. The separation between the slag and the alloy may thus be poorly defined and may be a source of inclusions in the alloy.

Similarly, the carbon-containing ceramic materials can cause carburization of the rare earths. Products such as boron nitride could be used, but industrial use thereof is compromised by their cost. Refractory materials of the same nature as the slag produced are the only ones capable of not polluting the alloy, providing that the duration and temperature of the operation are limited so that the flux introduced into the reaction medium is not able to attack the refractory material.

OBJECT OF THE INVENTION

The object of the invention is, therefore, to obtain a master alloy intended mainly for the production of permanent magnets containing one or more rare earths (including yttrium) in which Fe may be partially substituted or supplemented by another transition element such as cobalt, nickel, tin, zinc . . . and possibly other elements such as boron, of high purity, without inclusions or pollution by tghe reagents or other products present and under economic industrial conditions (high yield close to or higher than 95%, consumption of weak reagents, high productivity).

A further object is to obtain this alloy by metallurgical thermal reduction from common compounds of rare earths, used alone or in a mixture and having a positive degree of oxidation, such as oxides and/or halides, using any alkali or alkaline earth metal, for example sodium, calcium or magnesium.

A further object is to obtain ingots of alloy of greatly varying sizes, ranging from a few kg to more than 1 ton.

A further object is to obtain ingots of alloy without casting (although the use of a casting process is also possible), having a highly homogeneous composition and very smooth surface states, after cooling, so that they can be marketed without washing or other remelting or purification treatments, a light pickling treatment being sufficient. In other words, the object is to separate the alloy from the slag very well, with easy recovery of each, the alloy containing no inclusions of slag and vice-versa.

A further object is to develop a simple and quick process, in particular without using a special atmosphere, for example vacuum and/or inert gas, and without using a charge of slag flux.

A further object is the possibility of recycling the slag generated after elimination of the soluble elements which can themselves be recovered.

DESCRIPTION OF THE INVENTION

The invention relates to an industrial process for obtaining (preferably without casting), high purity ingots of master alloy, mainly with the view to using them for the production of permanent magnets, based on rare earths and containing at least one of more transition metals such as, preferably but not in a limiting manner, iron, cobalt, nickel and optionally other elements such as boron, silicon, aluminium, in general containing any element capable of improving the metallurgical and/or magnetic qualities (Curie point, coercive field, residual induction) in the alloys obtained. It is a process which works by metallothermic reduction of a compound of the rare earths (including yttrium) or of a mixture of these compounds using a reducing agent such as the alkali or alkaline earth metals such as sodium, calcium, magnesium or the reducing compounds thereof such as hydrides.

It is characterised in that a starting reaction mixture is made up while incorporating into it the transition metal, at least in part in the form of a compound and a complement of reducing agent to reduce this compound, the reaction medium thus obtained is introduced into a reaction vessel, such as a container or crucible which has preferably previously been coated internally with refractory dry lute having a high melting point the reaction is then triggered either by heating the crucible from the exterior to a moderate temperature generally not exceeding 300° C., or by direct priming using known devices (priming charges, electricity).

The crucible is then set to cool in the open air or using any other known means, the charge in the crucible is removed from its mould once it has solidified and is sufficiently cool, and the alloy ingot is then separated from its slag.

The starting reaction mixture therefore comprises:

Compounds of one or more rare earths (including yttrium and misch metal), in particular neodymium alone or supplemented by praseodymium (didymium) and/or dysprosium or other rare earths. The types of compounds used are, in particular, the oxides or preferably the halides, in particular the fluorides; a mixture of several types of compound may be used, but it is preferable to use only one.

One or more transition metals which form the alloy and are introduced into said mixture, at least in part in the form of compounds; these metals are, more specifically, those belonging to the group formed by Fe, Co, Ni, V Cr, Bi, Ge, Ga, Pb, Ag, Au, Be, Zn, Ti, Nb, Ta, Cu, Mo, W, Mn, Sb, Sn, Zr, Hf or others, but preferably Fe, Co, Ni and, more particularly, Fe. The compounds are generally oxides and halides, more particularly chlorides such as those of iron, for example iron chloride, and are preferably used alone or in a mixture, a mixture of different anions and/or different cations. These transition metals can also be introduced into the starting mixture only in part in their elementary form. A particularly interesting application of the process involves introducing at least one iron compound, preferably ferric chloride into the starting mixture.

Optionally compounds such as boron which may be introduced in its elementary form or in the form of compounds such as its oxide, its halides or ferroboron, or supplemented by elements such as C, P, S, Cu, Si, Al.

The solid reducing agent, in the form of granules, filings, shavings, pellets . . . .

The compounds of the rare earths, as the compounds of the transition metals or of other alloying elements, are preferably used in their anhydrous form.

The reaction mixture should preferably be dry and may be used in the form of powder or pellets. In particular, it may be necessary to carry out an operation for drying the various compounds before making up the mixture so that its water content does not exceed 0.5%, but these products are not generally hygroscopic and have humidity of less than 0.1%.

The presence of the transition metals in the form of reducible compounds in an adequate quantity is necessary for contributing to the thermal balance of the reaction, in particular to the melting of the reaction charge.

In general, it is very important for the anions bound to the rare earths and those bound to the transition metal constituting the alloy to be different so as to obtain a low melting point slag after reduction. For example, a rare earth oxide or fluoride and a transition metal chloride (Fe, for example) may be used. Thus, the addition of a slag flux is not generally necessary although it may be useful in certain circumstances.

In particular, the use of ferric chloride is advantageous because, in addition to the fact that it is a product which is readily available commercially in industrial quantities, whereas the fluoride, for example, is not available in industrial quantities and its price prohibits use thereof, it has the feature of producing a markedly exothermic reaction while it is being reduced.

The quantity of the various products of the reaction mixture is adjusted mainly according to the composition of the alloy to be obtained. The respective quantities of rare earths and transition metal may also preferably be selected so that a low melting point alloy is obtained at the end of the reaction, in the region, for example, of its eutectic composition (Fe and Nd in this particular case), the possible alloying element being added to this composition. Furthermore, an essential criterion in the choice of the quantity of compound or compounds of the transition metal or metals, which has to be present, is based on the quantity of calories liberated by the reduction of said compounds which must be sufficient to cause melting of the entire reaction charge, including the transition metal possibly added in part in elementary form and to bring it to a sufficiently high temperature to assist separation of the alloy and slag. The slag generated during the reduction of the transition metal compound also acts as a flux for the slag issuing from the reduction of the rare earth compound.

This process can be applied, in particular, to the production of master alloy ingots of high purity, based on neodymium and iron, which can also contain praseodymium and/or dysprosium in addition to or in partial substitution for the neodymium and optionally boron. This master alloy may be used, after subsequent adjustment of the compositions, for the production of permanent magnets containing approximately 34% Nd, 65% Fe, 1% B. This example will serve to illustrate determination of the composition of the starting reaction mixture and, in this case, the rare earth to Fe ratio by weight of 88:12 is the most favourable for obtaining a low melting point master alloy of which the composition may subsequently be adjusted to the value desired for the final magnet. However, the proportion of the compound of the transition metal or metals introduced into the starting reaction mixture is generally varied in such a way that the ratio of the weight of said transition metal or metals introduced in the form of a compound to the weight of the rare earth plus transition metal aggregate is between 5 and 50% and preferably between 10 and 20%. These ranges of value are particularly recommended if the transition metal is iron and is used in the form of chloride, for example ferric chloride.

The final content of transition metal or metals in the alloy may be obtained by introducing it or them into the starting reaction mixture, in part in the form of compounds within the ranges of contents mentioned above and in part in elementary form (for example ferric chloride plus Fe and/or plus cobalt) so that the exothermic heat liberated by the various reduction reactions is such that the alloy obtained and the slag generated melt and have a sufficiently low viscosity for achieving good separation of alloy and slag. As already mentioned above, an element such as boron in elementary form or in the form of compounds may also be added to the reaction mixture.

The reducing agent is introduced in a slight excess relative to the total quantity required for reducing all the compounds to be reduced, possibly including the compounds of boron or other elements. This excess is generally between 0 and 20% and preferably between 0 and 10%.

A container or crucible of some shape, adapted in particular to the shape to be given to the ingot of alloy and to the slag, is used for carrying out the reaction to facilitate release from the mould, subsequent machining or any other operations.

The crucible material is of any type and should be resistant to the mechanical and thermal stresses received during filling, during the metallurgical thermal reaction, cooling or casting, mould release and/or the cleaning operation carried out between each metallurigal thermal production process. A metallic crucible, in particular made of steel, is preferably selected.

A crucible having a double casing which is cooled by a fluid, for example water, or again a crucible lined with a compact and refractory dry internal lute having a high melting point can be used to prevent chemical corrosion. In general, The lute is of the same type as the slag generated by reduction of the rare earth compound, for example CaO, $CaF_2$, MgO, $MgF_2$. As it is a by-product of the reaction, it will be easy to recycle it, it will be available in sufficient quantities and will not be attacked by the molten molten alloy. Its thickness varies from 0.5 cm to 5 cm dependending on the size of the ingot produced. It may either be made up by introducing into the crucible a male former which thus defines an annular space into which the dry lute powder, which will be compressed by any suitable means (vibrator, impact table, etc.), is introduced, then by withdrawing the said male former shape, or it can be replaced by a refractory crucible which has been prefabricated, for example from said slag, to he dimensions of the metallic crucible into which it will be introduced.

The sufficiently homogenised reaction mixture is introduced inside the metallic or luted crucible. It may be compressed in order to increase the quantity introduced. A lute plug which is a few centimeters thick is produced above the upper surface of the mixture after the reaction mixture has possibly been degassed. The solid container may be left open, but it may be closed by means of a lid fixed to the crucible, for example by bolts, in order to prevent splashes which may occur during the reaction.

The reaction is then triggered by priming using a known means such as a priming charge, electric current or by heating by introducing the container into a furnace of any type (resistance furnace, fuel furnace, induction furnace, solar furnace) which has been brought to a moderate temperature of at least 150° C. and preferably between 150° C. and 300° C., which need not be exceeded. The heating period varies from 0.5 to 5 hours.

In fact, the reaction triggers itself and the heat liberated "in situ" is such that the reaction products melt. The temperature reached is generally at least 1300° C. The alloy rushes to the bottom of the luted crucible without attacking it and the low melting point slag floats while attacking said lute in part.

The reaction is quick and lasts only a few minutes. Thus, the alloy is not able to undergo substantial oxidation as it is protected by the slag generated. This generally allows the operation to be carried out at atmospheric pressure and in air. However, to avoid the risk of pollution by atmospheric oxygen, the operation may be carried out under reduced pressure or under inert or reducing atmosphere at normal pressure or at a pressure higher than atmospheric pressure.

The container is left to cool in the open air or is cooled by any other accelerated cooling means (water in the double casing, air stream, trickling water, soaking, etc.).

Once the crucible is sufficiently cold to be handled easily, it is emptied of its solidified contents: alloy, slag, lute. The ingot which separates easily from the slag and the lute is then cleaned and machined to remove any adhering slag.

This process allows ingots of alloy without inclusions, of high purity and of homogeneous composition to be obtained. The yields are generally close to or higher than 95%, without the need for stirring during the reaction nor long duration heating at high temperatures.

As just mentioned, this process can be carried out without casting. However, the metal and/or slag may be cast, if necessary, before the cooling and solidification operation, using any known devices.

Furthermore, the process according to the invention may advantageously be completed with recovery of the high melting point lute contained in the slag obtained. In fact, if said slag contains a soluble halide and an insoluble refractory fluoride or oxide, it may be treated with water (after possible crushing), the insoluble portion may be separated and then be dried and recycled after crushing and granule size adjustment so that it can be used for the lute of the crucible.

This is the case, for example, when the rare earth compounds are oxides or fluorides and the transition metal compounds are chlorides and the reducing agent is Ca or Mg. The slag is then treated with water, the calcium and/or magnesium chlorides are separated in the aqueous phase and the calcium and/or magnesium oxides or fluorides are separated in the solid phase and can then be recycled to produce the lute for the following operation or for any other use or for storage.

In a variation of the process, a transition metal compound may be introduced into the starting reaction mixture and produces, after reduction, a volatile metal which, in said variation, may be eliminated from the master alloy obtained, by distillation. The reaction mixture can thus contain, for example, the rare earth compound, a Zn compound such as its chloride, a further transition metal in elementary form such as Fe and the reducing agent.

The alloy is then obtained by the process according to the invention and the variation involves taking up the master alloy, remelting it under vacuum or under a controlled atmosphere and distilling the Zn to obtain the rare earth metal.

The following examples serve to illustrate various possible uses of the invention.

EXAMPLE 1

Preparation of the crucible and its lute:

A truncated cone shaped, mild steel crucible having a capacity of about 250 l, into which a male former is introduced in order to define an annular space of constant thickness is used. The crucible is fixed on a vibrating table.

A $CaF_2$ powder is dried at 150° C. for 24 hours then introduced into the annular space and simultaneously compressed by means of the vibrating table. After removal of the male former, the luted crucible is ready to receive the reaction mixture.

Preparation of the reaction medium.

119.6 kg of $NdF_3$ 53.2 kg of Ca 34 kg of anhydrous $FeCl_3$ that is $Fe/RE+Fe=12\%$ (RE: Rare earths) and a 10% excess of calcium are mixed hastily. This mixture is introduced into the crucible which is internally lined with its lute.

A layer of lute forming a plug is placed above the mixture and the crucible is closed by a steel lid bolted on the crucible. A thermocouple is placed in contact with the external wall of the crucible.

The reaction

The crucible is placed in a furnace. it is heated progressively to a temperature of 150° C. in 0.5 h, a plateau is maintained at this temperature until the triggering of the reaction is observed on the thermocouple; it occurs after 2 hours 45 minutes. The reaction lasts a few minutes. Heating is stopped, the crucible is removed from the furnace and is cooled in the open air.

Mould release—results

The crucible is turned upside down and emptied of its solid contents: the lute remains in the form of a powder and the ingot of master alloy is easily separated from the slag. The ingot is then brushed and cleaned before the samples are removed from it. The ingot obtained weighs 93.4 kg and its analysis is as follows (% by weight).

| | | |
|---|---|---|
| Nd | 86.8% | |
| Fe | 12.3% | |
| Ca | 0.4% | |
| Other impurities | 0.5% | (Al, Si, Mg, Cl, F, Mn, Ti, $O_2$, $N_2$) |
| Nd yield | 94.6% | |

EXAMPLE 2

The same procedure as in example 1 was followed, but the starting mixture differs in that its Fe/RE+Fe ratio is 20% and the excess of Ca is 20%. Its composition is as follows:

107.1 kg of $NdF_3$ 55.7 kg of $FeCl_3$ 63.2 kg of Ca.

The ingot obtained weighs 94.4 kg and has the following composition (% by weight):

| | |
|---|---|
| Nd | 80.8% |
| Fe | 18.0% |
| Ca | 0.41% |
| Other impurities | 0.79% |

The rare earth yield is 99.4%.

EXAMPLE 3

In this example, a proportion of the Fe was added to the starting reaction mixture in metallic form. The same procedure as in Example 1 was followed but with a smaller crucible.

Composition of the mixture:

| | |
|---|---|
| $NdF_3$ | 948 g |
| $FeCl_3$ | 493 g |
| Ca | 560 g |
| Fe | 390 g |

In this case we have a ratio between Fe (in compound form) and rare earths plus total Fe of 13.7% and a Ca excess of 20%.

The ingot obtained weighs 1220 g and its composition is as follows:

| | |
|---|---|
| Nd | 55.1% |
| Fe | 44.0% |
| Ca | 0.1% |
| Cl | 0.04% |
| F | 0.06% |
| Other impurities | 0.7% |

The rare earth yield is 98.9%.

EXAMPLE 4

In this example, a proportion of the Fe in metal form from the preceding example is replaced by ferroboron having a composition of the mixture as follows:

| | |
|---|---|
| $NdF_3$ | 948 g |
| $FeCl_3$ | 493 g |

-continued

| | | | |
|---|---|---|---|
| Ca | 560 g | | |
| Fe | 246 g | | |
| Ferroboron | 169.5 g, that is | Fe | 149.8 g |
| | | B | 19 g |

The Fe (in compound form)/rare earth plus total Fe ratio is 13.7%. The ingot obtained weighs 1214 g and its composition is as follows:

| | |
|---|---|
| Nd | 53% |
| Fe | 45.1% |
| B | 1.5% |
| Ca | 0.15% |
| Other impurities | 0.25% |

The rare earth yield is 94.7%.

EXAMPLE 5

The same procedure as in Example 1 was followed, but the neodymium was replaced by dysprosium. Composition of the starting mixture:

| | |
|---|---|
| $DyF_3$ | 2377.4 g |
| $FeCl_3$ | 1277.9 g |
| Ca | 1349.7 g |

That is a Fe/'RE+Fe ratio of 20%.

The weight of the ingot obtained is 2146.4 g. The composition of the ingot obtained is:

| | |
|---|---|
| Dy | 79.8% |
| Fe | 9.4% |
| Ca | 0.3% |
| Other impurities | 0.5% |

The rare earth yield is 97.4%.

What is claimed is:

1. A process for obtaining, high purity ingots of master alloy based on at least one rare earth and at least one transition metal by metallothermic reduction of a compound of said rare earth by means of a reducing agent selected from the group consisting of alkali and alkaline earth metals contained in a starting reaction mixture, which process comprises the steps of:

(a) preparing the starting reaction mixture by admixing the transition metal, at least in part in the form of a compound of which the anion differs from that of the rare earth compound, the rare earth compound, and the reducing agent, in an amount sufficient to reduce the rare earth compound;

(b) introducing the reaction mixture thus formed into a reaction vessel;

(c) triggering the metallothermic reduction reaction by effecting heating of the reaction mixture to a moderate temperature generally not exceeding about 300° C.

2. A process according to claim 1 characterised in that the starting reaction mixture contains a single rare earth compound.

3. A process according to claim 2, characterised in that the single rare earth compound is a neodymium compound.

4. A process according to claim 1, characterised in that the reaction mixture contains a mixture of rare earth compounds selected from the group consisting of neodymium, praseodymium and dysprosium compounds.

5. A process according to any one of claims 1 to 4, characterised in that the rare earth compound is selected from the group formed by the oxides and halides thereof.

6. A process according to claim 3, characterised in that the rare earth compound is fluoride.

7. A process according to claim 1, characterised in that the starting reaction mixture contains a single transition metal compound.

8. A process according to claim 7, characterised in that the single transition metal compound is iron in chloride form.

9. A process according to claim 1, characterised in that the starting reaction mixture contains a mixture of transition metal compounds.

10. A process according to any one of claims 1, 7, or 9 characterised in that the transition metal or metals are incorporated into the starting reaction mixture, in part in elementary form.

11. A process according to claim 1, characterised in that an oxide, fluoride, ferroboron or elementary form of boron is added to the reaction mixture.

12. A process according to claim 1, characterised in that the reducing agent is selected from the group consisting of calcium, magnesium and sodium.

13. A process according to claim 12, characterised in that the excess of reducing agent over the quantity required for reducing all the compounds present in the starting reaction mixture is at most 20%.

14. A process according to any one of claims 1, 2, 4, 7, 9, 11, 12 or 13, characterised in that the proportion of the compound or compounds of the transition metals in the starting reaction mixture is within the range of from 5 to 50% expressed in weight of metal relative to the weight of all the rare earths plus metal.

15. A process according to any one of claims 1, 2, 4, 7, 9, 11, 12 or 13, characterised in that the proportion of the compound or compounds of the transition metals in the starting reaction mixture is within the range of from 10 to 20% expressed in weight of metal relative to the weight of all the rare earths plus metal.

16. A process according to claim 1, characterised in that the reaction vessel has a double casing cooled by a fluid.

17. A process according to claim 1, characterised in that the reaction vessel is internally lined with a lute.

18. A process according to claim 16 or 17, characterised in that the reaction mixture is covered with a lute plug and by a lid fixed to the reaction vessel, once it has been introduced into the reaction vessel.

19. A process according to any one of claims 1, 2, 4, 7, 9, 11, 12, 13, 16 or 17, characterised in that, when the master alloy obtained contains a volatile metal, said alloy is remelted and the volatile metal eliminated by distillation.

20. A process according to claim 1, characterised in that the reaction is triggered by heating the reaction vessel which has previously been lined internally with the lute and filled with the reaction mixture, to a temperature of between 150° C. and 300° C.

21. The process of claim 1, wherein the reaction vessel is a crucible.

22. The process of claim 1 carried forth with casting of the master alloy obtained.

* * * * *